US008590311B2

(12) United States Patent
Parsania et al.

(10) Patent No.: US 8,590,311 B2
(45) Date of Patent: Nov. 26, 2013

(54) POCKETED AIR AND FUEL MIXING TUBE

(75) Inventors: Nishant Govindbhai Parsania, Bangalore (IN); Gregory Allen Boardman, Greer, SC (US)

(73) Assignee: General Electric Company, Schenectady, NY (US)

( * ) Notice: Subject to any disclaimer, the term of this patent is extended or adjusted under 35 U.S.C. 154(b) by 741 days.

(21) Appl. No.: 12/768,758

(22) Filed: Apr. 28, 2010

(65) Prior Publication Data

US 2011/0265482 A1 Nov. 3, 2011

(51) Int. Cl.
*F02G 3/00* (2006.01)
*F02C 1/00* (2006.01)

(52) U.S. Cl.
USPC ..... 60/737; 60/738; 60/740; 60/742; 60/746; 60/747; 60/748

(58) Field of Classification Search
USPC ..... 60/737, 738, 740, 742, 746–748
See application file for complete search history.

(56) References Cited

U.S. PATENT DOCUMENTS

| | | | | |
|---|---|---|---|---|
| 4,222,243 | A | 9/1980 | Mosby | |
| 5,062,792 | A | 11/1991 | Maghon | |
| 5,540,056 | A | 7/1996 | Heberling et al. | |
| 5,577,386 | A | 11/1996 | Alary et al. | |
| 5,596,873 | A | 1/1997 | Joshi et al. | |
| 5,611,684 | A * | 3/1997 | Spielman | 431/353 |
| 5,619,855 | A | 4/1997 | Burrus | |
| 6,354,072 | B1 | 3/2002 | Hura | |
| 6,357,237 | B1 | 3/2002 | Candy et al. | |
| 6,363,726 | B1 | 4/2002 | Durbin et al. | |
| 6,367,262 | B1 | 4/2002 | Mongia et al. | |
| 6,381,964 | B1 | 5/2002 | Pritchard, Jr. et al. | |
| 6,418,726 | B1 | 7/2002 | Foust et al. | |
| 6,536,216 | B2 | 3/2003 | Halila et al. | |
| 6,925,809 | B2 * | 8/2005 | Mowill | 60/737 |
| 7,310,952 | B2 | 12/2007 | Howell et al. | |
| 8,113,001 | B2 * | 2/2012 | Singh et al. | 60/742 |
| 2008/0078181 | A1 * | 4/2008 | Mueller et al. | 60/776 |
| 2010/0275601 | A1 * | 11/2010 | Berry et al. | 60/737 |
| 2011/0107765 | A1 * | 5/2011 | Valeev et al. | 60/746 |

* cited by examiner

*Primary Examiner* — Gerald L Sung
*Assistant Examiner* — Craig Kim
(74) *Attorney, Agent, or Firm* — Nixon & Vanderhye, P.C.

(57) ABSTRACT

An improved mixing tube design and fuel nozzle that allows for a more uniform and thorough mixing of fuel and air being fed to the combustor of a gas turbine engine, wherein each of a plurality of mixing tubes comprises a pair of concentric hollow cylinders that define a ring-like, annular path for the flow of fuel between the two hollow cylinders in each mixing tube, a plurality of air injection slots formed in the concentric hollow cylinders defining corresponding air flow paths from the outside into the interior of each mixing tube, and one or more fuel injection ports formed in selected ones of the plurality of air injection slots that allow for the flow of fuel from the annular path formed by the hollow cylinders into the air flow path, resulting in significantly better mixing and improved thermodynamic behavior of the fuel and air mixture downstream of the nozzle and upstream of the combustor.

15 Claims, 12 Drawing Sheets

POCKETED AIR AND FUEL MIXING TUBE

BACKGROUND OF THE INVENTION

The present invention relates to combustion systems for gas turbine engines and, more particularly, to an improved fuel nozzle design that significantly enhances the mixing of fuel and air prior to combustion, thereby increasing the overall efficiency of an entire gas turbine system, while reducing unwanted pressure fluctuations in the combustion gases and limiting the release of undesirable gas emissions into the atmosphere.

Gas turbine engines typically include one or more combustors that burn a mixture of compressed air and fuel to produce hot combustion gases that drive the turbine to produce electricity and normally include multiple combustors positioned circumferentially around a rotational axis. It is known that air and fuel pressures within each combustor can vary over time, often resulting in unwanted variations of the air/fuel mixture that cause incomplete (and thus less efficient) combustion, as well as potential unwanted pressure oscillations in the combustion gases at certain frequencies. If a combustion frequency corresponds to the natural frequency of a component part or subsystem within the turbine engine, damage to that part or the engine itself may occur over time even during normal operation.

The need for improved techniques to mix fuel and air being fed to gas turbine engines is also a direct outgrowth of air pollution concerns worldwide that have resulted in more stringent emissions standards in recent years, both domestically and internationally. Most gas turbine engines are governed by strict standards promulgated by the Environmental Protection Agency (EPA) which regulates the emission of oxides of nitrogen, unburned hydrocarbons, and carbon monoxide, all of which can contribute to urban photochemical smog problems. The same environmental standards necessarily influence the operation of gas turbine engine combustors. Thus, a significant need still exists for combustor designs that provide a more efficient, low cost operation with reduced fuel consumption and improved emissions control.

Gas turbine engine emissions generally fall into two main classes, namely those formed due to high combustion flame temperatures ($NO_x$) and those formed because of low flame temperatures that do not allow the fuel-air reaction to proceed to completion. Operating at low combustion temperatures to lower the $NO_x$ emissions can result in incomplete or partially incomplete combustion, which in turn can lead to the production of excessive amounts of unburned hydrocarbons (HC) and carbon monoxide (CO), as well as lower power output and lower thermal efficiency of the engine. Higher combustion temperatures, on the other hand, tend to improve thermal efficiency and lower the amount of HC and CO, but can still result in a higher output of $NO_x$ if the combustion mixture and operating conditions are not properly monitored and controlled.

One proposal to reduce the production of undesirable combustion by-products is to provide more effective intermixing of the injected fuel and air used during combustion. That is, burning (oxidation) occurring uniformly in the entire fuel/air mixture tends to reduce the potential for high levels of HC and CO that result from incomplete combustion. While numerous designs have been proposed over the years to enhance the mixing of the fuel and air prior to combustion, the need remains for improvements in combustor design to reduce the level of undesirable $NO_x$ formed when the flame temperatures occasionally become too high (sometimes referred to as "high power" conditions). Improvements in $NO_x$ emission during high power conditions are also a significant concern in the gas turbine field, and thus the industry continues to search for pre-combustion systems that provide improved fuel/air mixing upstream of the combustor and increased thermal efficiency, but with reduced $NO_x$ and unburned hydrocarbon emissions after combustion.

BRIEF DESCRIPTION OF THE INVENTION

The present invention provides for an improved fuel nozzle design for use in a gas turbine engine that allows for a more uniform and thorough mixing of fuel and air being fed to the combustor. In one exemplary embodiment, the fuel nozzle includes a plurality of uniquely configured fuel/air mixing tubes, each of which comprises a pair of concentric hollow cylinders that define a ring-like annular path for the flow of fuel between the two hollow cylinders in each mixing tube, a plurality of air injection slots formed in the concentric hollow cylinders that create corresponding air flow paths from the outside into the interior of each mixing tube, and one or more fuel injection ports formed in selected ones of the air injection slots that allow for the flow of fuel from the annular path formed by the hollow cylinders directly into the air flow path. The new mixing tube and nozzle designs result in significantly improved mixing and improved thermodynamic behavior of the fuel and air mixture downstream of the nozzle before it reaches the combustor. The present invention also contemplates a new fuel and air combustion system for a gas turbine engine comprising a combustor, a fuel supply for providing hydrocarbon fuel to the combustor, a compressed air supply to the combustor and an improved fuel and air nozzle design upstream of the combustor using the unique mixing tube configuration described below.

BRIEF DESCRIPTION OF THE DRAWINGS

FIG. 98 is a perspective view showing the liquid/compressed air fuel injection system depicted in the embodiment of FIG. 8;

DETAILED DESCRIPTION OF THE INVENTION

Figure 1:
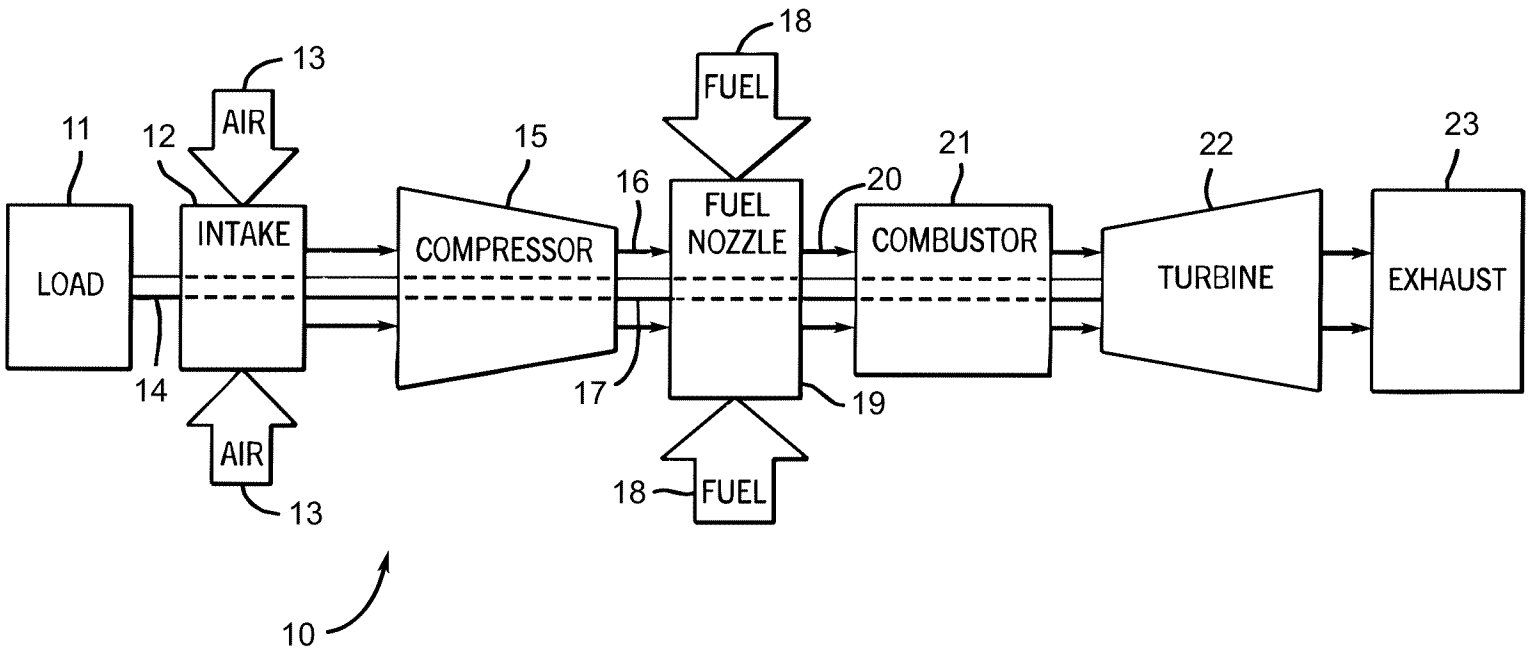
FIG. 1 is a block diagram of an exemplary gas turbine engine system using a fuel nozzle comprising multiple distributed air and fuel mixing tubes according to the invention that provide improved air and fuel mixing.

As noted above, the present invention increases combustion efficiency in gas turbine engines while reducing unwanted gas emissions and pressure fluctuations by significantly improving the mixing of the fuel and air feed components to the combustor. The improved mixing is achieved by using nozzles comprising a plurality of mixing tubes, each of which has a precise number of apertures for the air feed, together with a select number of fuel injection ports in certain air slots to allow for the controlled mixing of fuel and air at specific locations and at controlled flow rates along the longitudinal axis of each mixing tube. The exact size, location and orientation of the apertures and fuel injection ports result in a more uniform and distributed air/fuel mixing upstream of the combustor. The invention also includes a new fuel nozzle design upstream of the combustor of a gas turbine engine, comprising a plurality of the exemplary fuel and air mixing tubes disposed at equidistant radial positions about the longitudinal axis of the nozzle.

In one embodiment, each new mixing tube includes an upstream portion having a series of apertures (slots) that permit air flow (with some apertures having fuel injection ports) and a downstream portion of the mixing tube without apertures. All of the mixing tube embodiments described herein tend to induce swirl within the mixing tube, where the degree of swirl varies depending upon the axial position of the apertures along the length of the tube. The swirling effect tends to improve mixing, enhance diffuser pressure recovery and improve flame stability at the nozzle outlet just prior to combustion. In effect, the design extends the fuel/air path length through the mixing tube, thereby slightly increasing the residence time of the fuel and air before combustion.

The mixing tube and nozzle designs in the figures below tend to reduce combustor driven oscillations in the system by improving the fuel-air mixing in time and space. Combustor driven oscillations result from pressure oscillations in the combustor as the fuel and air enter, mix and ignite inside the combustor. The unwanted oscillations cause increased wear and potential damage to rotating components both upstream and downstream of the combustor, but can be reduced or minimized by reducing upstream pressure oscillations in the fuel and air supplied to the combustor. It has been found that the mixing tube designs described herein tend to reduce unwanted pressure oscillations in the fuel/air mixture.

A first exemplary embodiment of the invention includes a fuel nozzle that outputs a specific, desired mixture of fuel and air using a plurality of uniquely configured mixing tubes comprised of concentric hollow cylinders sized to receive compressed air and a portion of fuel from a gas fuel injector. One of the hollow cylinders is positioned radially inward from the outer cylinder and thus has a slightly smaller diameter. Together, the concentric hollow cylinders define a ring-like annular space for the flow of fuel that can be mixed with an air feed from the outside.

Each mixing tube in the nozzle thus combines the fuel and air using a plurality of angled slots passing through the concentric cylinders, some of which are at prescribed locations downstream of the fuel injection. Nominally, the slots are angled relative to the longitudinal axis to facilitate airflow into the mixing tube and create a swirling motion inside the tube at the point of entry, with the amount of swirl and mixing varying depending upon the size and axial position of the openings along the length of the tube.

The companion fuel injection passages or "ports" are formed through and into one side of certain of the angled slots in order to provide the fuel component of the fuel/air mixture at prescribed locations in each tube. The gas fuel is fed into the ring-like annular space between the two hollow cylinders and thereafter injected into the air flow path using a plurality of small, "pin-hole" type fuel injection ports where the fuel combines with air flowing through the slots from the outside into the center of the mixing tube. The plurality of angled slots thus form a series of evenly spaced, circumferential rows of openings (typically less than six rows) along a prescribed length of the tube, with only certain of the slots having fuel injection ports in the annular space defined by the concentric cylinders. This precisely controlled fuel injection results in very rapid and efficient mixing of air and fuel almost immediately after the fuel injection occurs. The design also helps to alleviate many of the process control issues encountered with fuel injection in prior art nozzle designs.

It has been found that the invention can be used in two basic types of flame stabilization nominally identified as "bluff body" and "swirl driven." In order to ensure improved combustion, a need exists to lower the velocity of the fuel/air mixture near the point of combustion, thereby stabilizing the flow into the combustor. A conventional "bluff body" typically includes a geometric obstruction in the main gas path that serves to reduce velocity while stimulating gas recirculation upstream of the combustor. "Swirl driven" flame stabilization, on the other hand, refers to a type of air/fuel mixture stabilization that does not require a geometric obstruction in the flow path. As detailed below, the use of angled slots and injection ports accomplishes swirl driven flame stabilization, with or without an additional "bluff body" positioned upstream of the combustor.

With the above general descriptions in mind and by way of summary, the following process variables have been found to effect the operation of the fuel/air mixing tube and nozzle designs according to the invention: (1) the total effective open area of the apertures (slots) in each mixing tube (which relates directly to the total number of angled slots in each tube); (2) the physical size (dimensions) of the individual angled slots; (3) the number of rows of slots on each tube; (4) the relative axial position of the slots in each row; (5) the angle of the slots relative to the longitudinal axis of the mixing tube; (6) the size of the fuel injection ports (e.g., pin holes) in selected rows of angled slots (based in part on the desired fuel/air ratio at different locations upstream of the combustor; (7) the exact position of the fuel injection ports in certain of the angled slots; (8) the use of additional liquid fuel injection (atomized fuel) in one or more mixing tubes in the fuel nozzle; and (9) the exact stoichiometric composition of the liquid and/or gas fuel streams used in the nozzle (e.g., natural gas, diesel fuel, etc.).

Turning to FIG. 1, a block diagram of an exemplary turbine system 10 is illustrated having a fuel nozzle coupled to a combustor, with the fuel nozzle being configured to provide improved air and fuel mixing using a plurality of mixing tubes in accordance with the invention. The block flow diagram includes fuel nozzle 19, fuel supply 18 and combustor 21. As depicted, fuel supply 18 routes a liquid hydrocarbon fuel and/or gas fuel, such as natural gas, to the turbine system 10 through fuel nozzle 19 into combustor 21. Fuel nozzle 19 is configured to mix and then inject the fuel with compressed air in the manner described above to improve combustion efficiency while minimizing combustor driven oscillations. Combustor 21 ignites and combusts the fuel-air mixture, and then passes hot pressurized exhaust gas into turbine 22. The exhaust gas passes through turbine blades in turbine 22 driving the turbine to rotate. In turn, the coupling between blades in turbine 22 and shaft 17 cause the rotation of shaft 17 coupled to other components in turbine system 10 as illustrated. Eventually, the exhaust of the combustion process is discharged via exhaust outlet 23.

FIG. 1 also shows load 11 coupled to the compressor via shaft 14 with ambient air 13 being fed to the system through air intake 12. The inlet air feeds into compressor 15 with outlet 16 and combined with fuel to form combustor feed line 20. Compressor vanes or blades included as components of compressor 15 are coupled directly to shaft 17 and rotate as shaft 17 is driven to rotate by turbine 22. Load 11 may be any suitable device that generates power via the rotational output of turbine system 10, such as a power generation plant or an external mechanical load, e.g. an electrical generator.

As FIG. 1 illustrates, air intake 12 draws air 13 into turbine system 10 via a suitable mechanism, such as a cold air intake, thereby mixing the air with fuel supply 18 via fuel nozzle 19. Air 13 may be compressed by rotating blades within compressor 15 and then fed into fuel nozzle 19, as shown by arrow 16. Fuel nozzle 19 mixes the pressurized air and fuel shown at 20 to produce a suitable mixture ratio for combustion.

Figure 2:
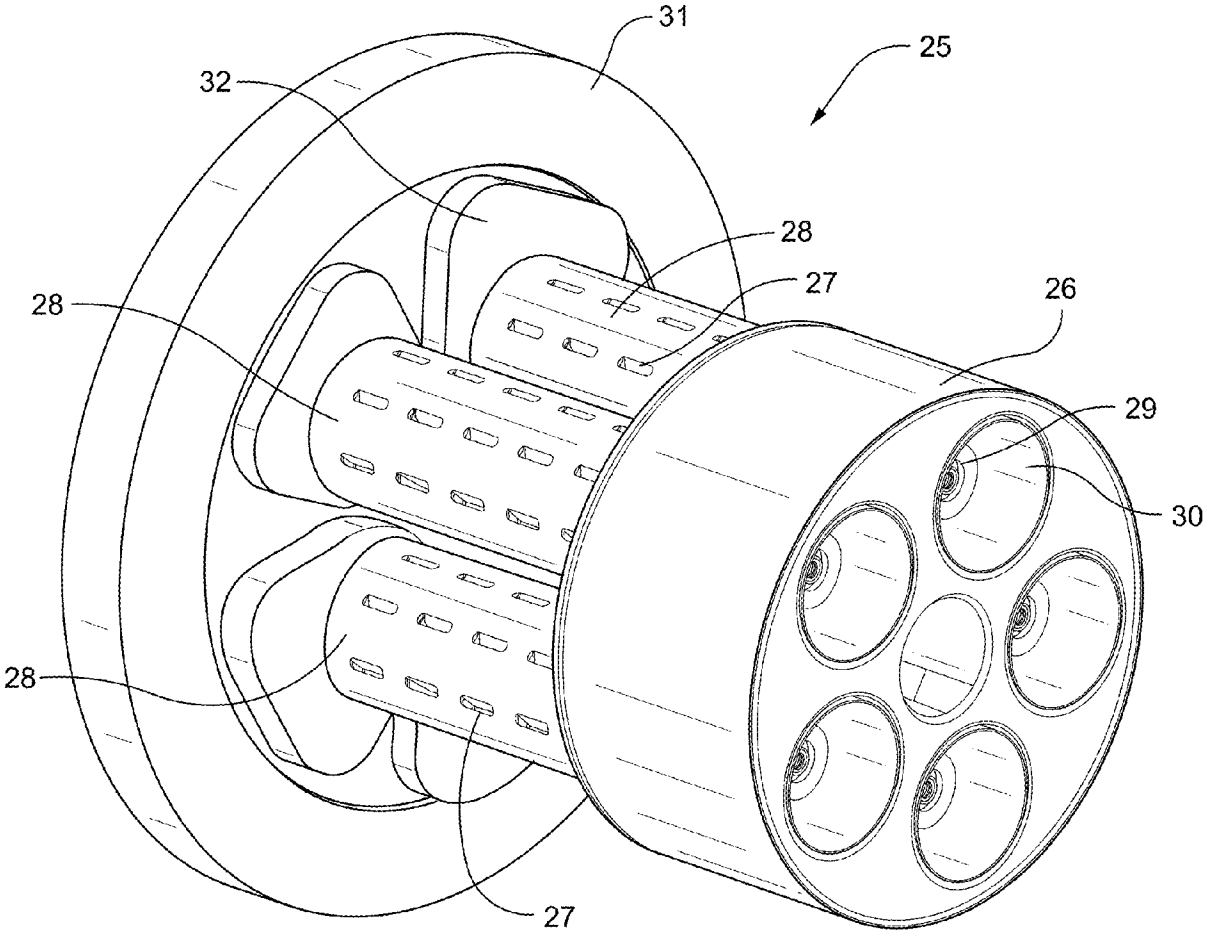
FIG. 2 is perspective view of a first embodiment of a fuel nozzle according to the invention depicting a plurality of exemplary mixing tubes, each of which comprises two concentric hollow cylinders connected by a series of uniformly spaced apertures (slots) and fuel injection ports.

FIG. 2 of the drawings is a perspective view of a first embodiment of a fuel nozzle assembly depicting in greater detail a plurality of fuel and air mixing tubes according to the invention, with each air and fuel mixing tube having a uniformly-spaced slotted configuration as shown. The fuel nozzle assembly, depicted generally as 25, includes a plurality of mixing tubes (in this example five tubes, each identified as item 28), with all tubes secured to a fuel nozzle assembly end plate 31 by virtue of corresponding individual mounting flanges as shown at 32. In this embodiment, the mixing tubes are secured to the end plate and oriented at equidistant angular positions relative to the center of end plate 31 and thus secured parallel to one another along a common longitudinal axis.

As FIG. 2 illustrates, each of the mixing tubes 28 in the fuel nozzle assembly 25 includes a plurality of uniformly-spaced fuel and air injection slots shown by way of example as 27 and described in greater detail below. The center body/diffusion tip 29 of each individual mixing tube in fuel nozzle assembly 25 is enclosed within end cap assembly 26, which in turn discharges the fuel and air mixture from all mixing tubes in the nozzle directly into a common combustor feed stream. Under certain operating conditions, each of the mixing tubes can be combined with a liquid fuel injector of the type described below in connection with FIG. 5 and shown generally at 29 in FIG. 2. However, the invention can also be used without any such additional liquid fuel injection system. In either embodiment, the fuel gas mixture formed in each mixing tube discharges from the end cap assembly 26 as shown at 30. An exemplary end cap assembly 26 typically includes a housing that encloses the plurality of mixing tubes as shown, with individual fuel/air outlets 30 corresponding to each mixing tube in the assembly.

Only certain of the fuel and air injection slots 27 in the embodiment of FIG. 2 allow for the injection of fuel through associated injection ports. It has been found that adding air alone without fuel at locations upstream the fuel injection helps to increase the air velocity at the downstream injection points where the mixing actually occurs with injected fuel. The increased air velocity and improved mixing at the downstream points helps to prevent the final fuel/air mixture from igniting prematurely as the mixture approaches the combustor. This "swirl driven" flame stabilization characteristic of the nozzle configuration improves the overall flow pattern of the fuel/air mixture to the combustor and ensures that the flow remains smooth and uniform at the exit of each mixing tube. Exemplary flow rates for the total air and fuel being fed into each nozzle with multiple mixing tubes are about 60 lb/sec and 1.85 lb per second, respectively.

Figure 3:
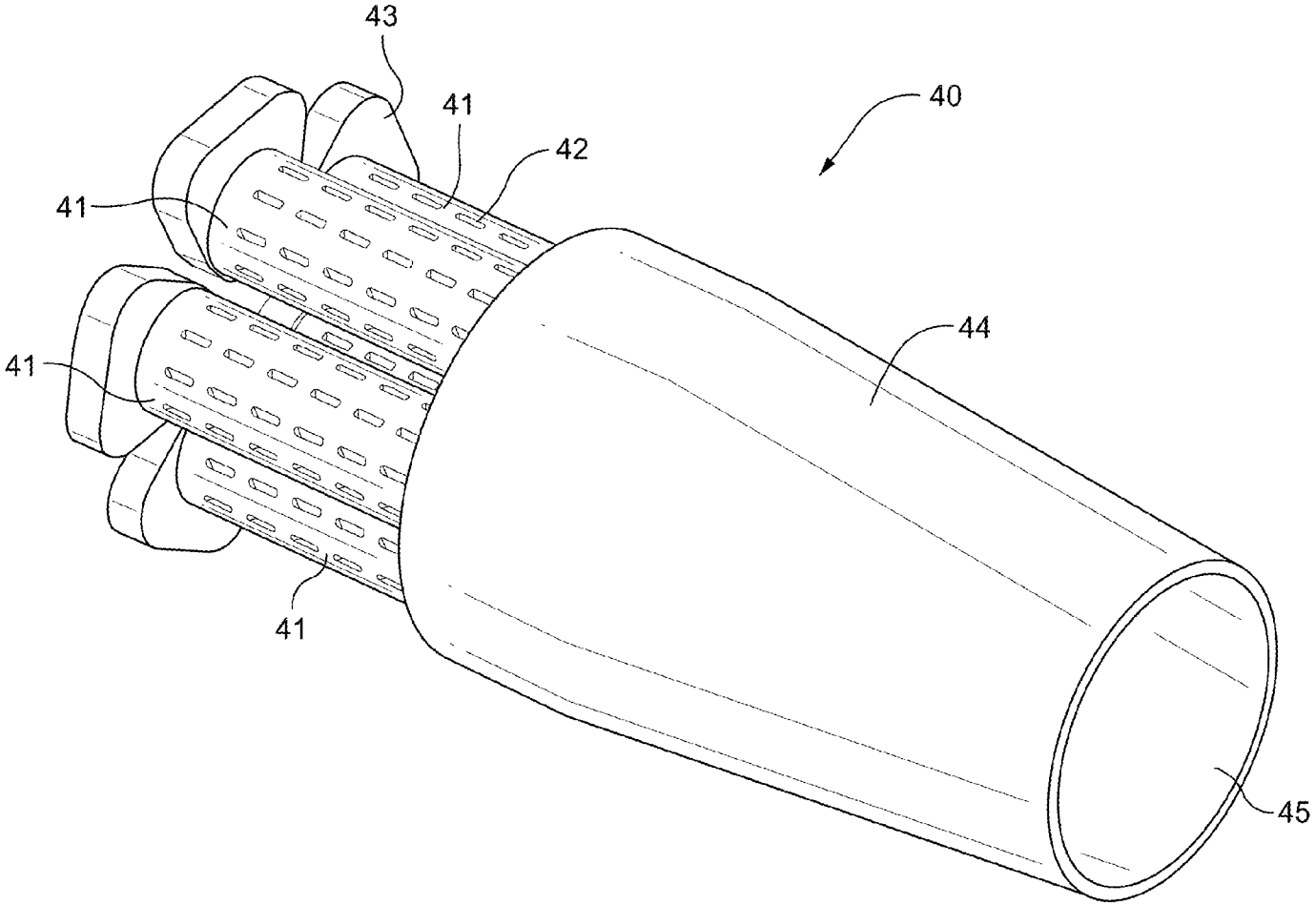
FIG. 3 is perspective view of an exemplary fuel nozzle according to the invention coupled to a liner or housing configured to enclose the entire nozzle, with the nozzle and liner comprising a plurality of fuel/air mixing tubes being upstream of the combustor in a gas turbine engine.

FIG. 3 is a perspective view of an exemplary fuel nozzle assembly 40 according to the invention, this time coupled to a housing or liner 44 that encloses the individual mixing tubes 41 mounted to corresponding individual mounting flanges 43 as described above and coupled to an end cap assembly (not shown). Each individual mixing tube 41 includes a plurality of uniformly-spaced air distribution slots that define air flow passages connecting the concentric tubes, with certain of the apertures also including fuel injection ports as described above. Again, the entire fuel nozzle assembly 40, including the housing, is installed upstream of the combustor in a gas turbine engine, with the combined fuel and air discharge shown at 45.

The nozzle configuration using concentric hollow cylinders and interconnecting apertures depicted in FIGS. 2 and 3 has various process control and environmental benefits apart from improved fuel/air mixing per se. For example, the new design tends to reduce combustion oscillations (sometimes referred to as "wave damping") due to the use of the symmetric fuel and air injection slots, i.e., with the angled fuel/air slots located at prescribed circumferential and longitudinal positions along the nozzle.

Figure 4A:
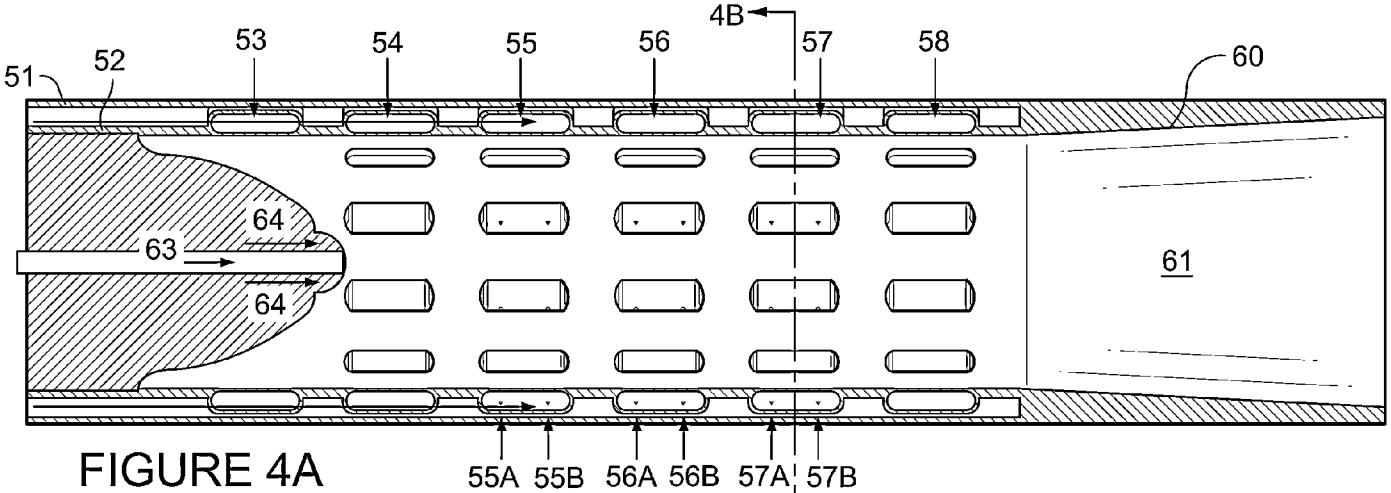
FIG. 4A is side view of an exemplary fuel/air mixing tube according to the invention shown partly in cross section to illustrate the relative configurations and orientation of the concentric cylinders and apertures forming the mixing tube.

FIG. 4A is side view of an exemplary fuel/air mixing tube configuration according to the invention shown partly in cross section to depict the geometric configuration and orientation of the concentric tubes forming an integral part the mixing tube, The mixing tube is shown generally at 50. The two concentric hollow cylinders 51 and 52 can be tapered slightly at the discharge end (typically only one or two degrees) as shown at 60 in order to slightly increase the static pressure at the discharge end of the tube at 61. The plurality of angled slots, in this case disposed in equally spaced rows at a tangential angle along a prescribed length of the mixing tube, are depicted as a series of six rows 53, 54, 55, 56, 57 and 58. As noted above, the exact size of the angled slots, the total number of slots and the exact angular orientation of the slots relative to the concentric tubes may vary, depending upon the desired downstream combustion conditions.

FIG. 4A also illustrates the use of fuel injection ports identified by arrows at 55A, 55B, 56A, 56B, 57A and 57B, fluidly connecting the concentric tubes in selected rows of angled slots, in this embodiment rows 55, 56, and 57, in a direction of flow proceeding from the left (inlet) side of the mixing tube. Again, the selection and orientation of the rows of air distribution slots that include fuel injection ports may change, depending on the exact desired fuel/air mixture at specific locations upstream of the combustor. Thus, the exact number and specific location of the angled slots themselves may vary, both circumferentially and along the length of the mixing tube. The fuel injection ports are also used only in certain selected rows of slots, again depending on the specific desired fuel/air mixture and mixing efficiency at different injection locations. For example, in the exemplary embodiment depicted in FIG. 4A, only the slots in circumferential rows 55. 56 and 57 have fuel injection ports, with the remaining slots upstream and downstream of those slots used solely for air injection into the nozzle. The upstream air distribution slots tend to provide initial axial and tangential momentum for the air inside the nozzle (in effect, creating an initial swirling flow) just before the first fuel injection occurs. The swirling inside the tube at those upstream points tends to improve the overall mixing and damping effects of the tube as the combined flow approaches the combustor.

FIG. 4A also shows the potential use of external atomizing air 63 along with a liquid fuel injection shown at 64 in combination with the exemplary mixing tube design described above. The use of such optional liquid fuel injection is explained in greater detail in connection with FIG. 8.

Figure 4C:
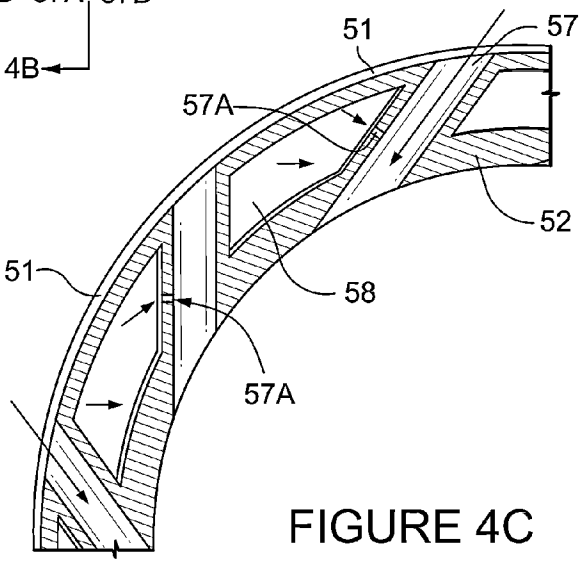
FIG. 4C is a cross-sectional view of a portion of the fuel/air mixing tube in FIG. 4B showing additional details of the uniformly configured apertures in each tube (sometimes referred to herein as "tangential" or "angled" slots)
Figure 4B:
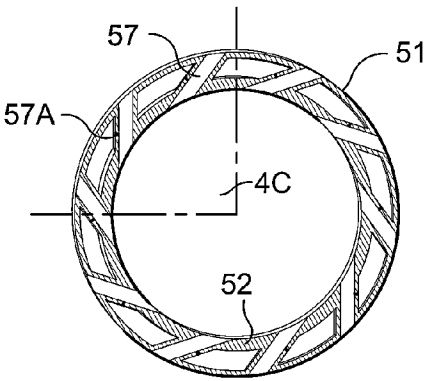
FIG. 4B is cross sectional view of the fuel/air mixing tube embodiment taken along the line shown in FIG. 4A.

FIG. 4B is cross sectional view of the mixing tube design taken along the line 4B in FIG. 4A. As indicated above, the hollow concentric tubes 51 and 52 include a plurality of angled slots shown generally as 57. The two fuel injection ports depicted at 57A and in this embodiment would be equally spaced from one another in each of the angled slots in rows 55, 56 and 57 with the air and gas flow moving from left to right toward the combustor. Thus, as compressed air flows into the slots from the outside and passes into the center of each mixing tube, fuel can be injected into the annular space between the two cylinders, and thereafter into and through the injection ports in selected slots and thus mixes with the air flow as the fuel is injected.

FIG. 4C is a cross-sectional view of a portion of the fuel/air nozzle design shown in FIG. 4B with additional details of the uniformly configured angled slots in FIG. 4B, again showing concentric tubes 51 and a plurality of slots that permit compressed air from the outside to enter the mixing tube (shown by way of example at 57) with gas fuel injection ports in selected tangential slots allowing fuel to flow from the annular space between the two concentric tubes into the slots as shown at 58. In this embodiment, a specific, predicted amount of gas fuel passing through the annular space defined by the concentric cylinders can be injected into the angled slots via the injection ports (typically two or more ports in each slot) as shown at injection port 57A.

Although FIG. 4C depicts the slots configured in a counter-clockwise manner (looking downstream from the nozzle toward the combustion zone), certain of the slots could also have a clockwise orientation, depending on the desired swirling effect and fuel/air mixing to be achieved by the mixing tubes. Thus, it has been found that the fuel/air flow can be modified by reorienting the angled slots, perhaps with some rows being clockwise and others counter-clockwise. The slots could also be angled differently (with the "tangent line" at different angles), depending on the level of counter-clockwise or clockwise flow desired inside the tube, e.g., some slots might be oriented in an essentially "straight" manner and perpendicular to the longitudinal axis of the mixing tube, while others could be positioned at a more acute angle relative to the outside surface of the tube. Under certain operating conditions, the opposite flow directions resulting from opposing slanted configurations in different rows of the nozzle may help to dampen unwanted oscillations in the air/fuel mixture while still achieving a high level of mixing upstream of the combustion zone. Other variations of slot design and orientation relative to the longitudinal axis are also possible depending on the end result desired.

Figure 4D:
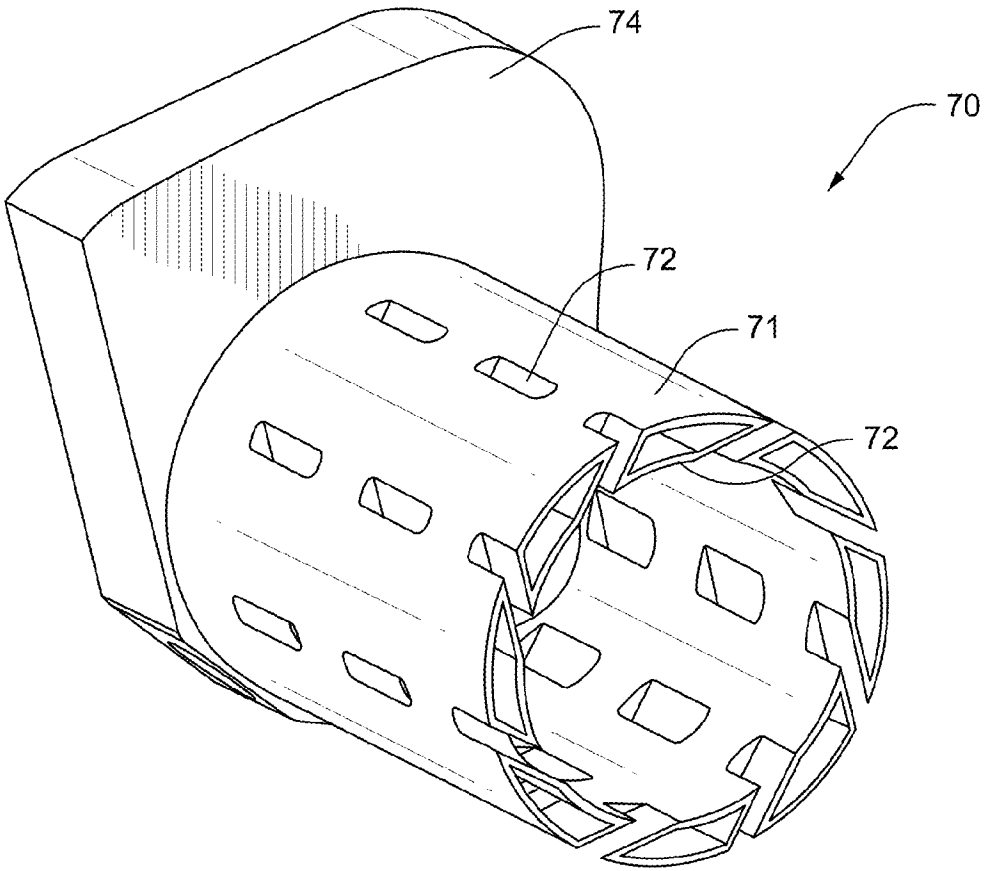
FIG. 4D is a partial perspective view of an exemplary fuel/air mixing tube depicting the use of concentric hollow cylinders to form the mixing tube and a plurality of uniformly spaced angled slots according to a first embodiment of the invention.

FIG. 4D is another perspective view of an exemplary mixing tube design 70 employing concentric hollow cylinders 71 and 72 for each mixing tube and a plurality of uniformly spaced slots 73 fluidly connecting the cylinders. The mixing tube is shown secured in place by mounting flange 74.

Preferably, the fuel injection ports depicted in FIGS. 4A, 4B, 4C and 4D are used in only certain rows of slots at prescribed axial distances along the length of the tubes, typically in the third, fourth and fifth rows. Thus, in addition to the air being distributed uniformly at different positions along the nozzle length, fuel is being distributed uniformly through the small injection points at those specific axial locations. As a result, the convection time, i.e., the amount of time for the fuel/air mixture to reach the combustor flame zone, will be slightly different at different locations along the longitudinal axis of the tube. That aspect of the invention differs from many prior art designs that have only a single convection time because the fuel is being added at only one location. In contrast, the use of slots and fuel injection ports at different locations along the longitudinal axis results in different convection times and tends to create a more uniform fuel/air mixture with less combustion vibration. The end result is a more stable gas/air feed into the combustion zone and a more uniform and efficient burn with less combustion vibration (reduced "flame wobbling").

One additional benefit of the design shown FIGS. 2 through 4D is a reduction in the number of nozzles required to achieve better and more uniform fuel/air mixing upstream of the combustion, resulting in lower total pressure losses in the system, which is particularly beneficial for systems using compressed air taken from other stages of the gas turbine engine. The relatively simple and straight-forward geometry of the hollow cylinder/angled slots also tends to reduce to overall costs of the nozzle and combustor.

Yet another advantage of the design depicted in FIGS. 2 through 4D is the reduced risk of flame-holding/flashback at selected locations upstream of the combustion zone. That is, it has been found that a compact "recirculation zone" forms downstream of the slots due to the resulting swirling air (with the swirl number being above a critical swirl number value), again indicating highly efficient mixing of fuel and air prior to combustion. This compact recirculation zone (a "recirculation bubble") formed downstream of the injection ports tends to improve overall flame stability. In addition, the end result of the embodiment using angled slots and selected injection ports in FIGS. 2 through 40 is an improved rotational and turbulent flow inside the tube at the points of injection, resulting in a reduction in unwanted pressure fluctuations, better flame stability (reduced "flame wobbling") and improved fuel/air ratios. The equivalence ratio of the fuel/air mixture as it proceeds into the combustion zone also improves, i.e., the theoretical stoichiometric fuel/air ratio divided by the actual fuel/air ratio.

The mixing tube configuration of FIGS. 2 through 4D also provides better control of the fuel/air mixture with fewer velocity fluctuations, lower combustion oscillations as the mixture reaches the combustor and fewer unwanted emissions after combustion takes place. The absence of uniform mixing at the point of combustion can cause combustion temperature variations and slightly higher burning temperatures, again resulting in unwanted emissions and/or pollutants.

Figure 5:
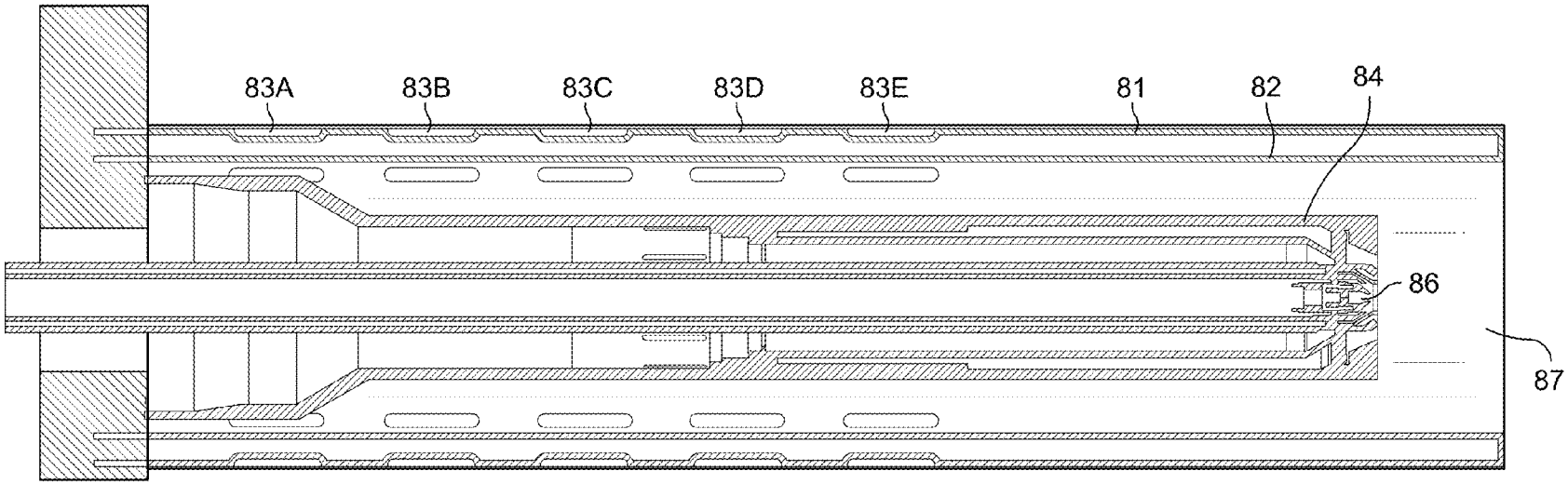
FIG. 5 is cross-sectional view of a liquid injector system for possible use in combination with an exemplary fuel/air mixing tube in accordance with the invention.

FIG. 5 is cross-sectional view of a liquid injector system for possible use in combination with another exemplary fuel/air mixing tube design in accordance with the invention, in this case combining the use of conventional fuel injection upstream of the angled slots as supplemental to the primary fuel air mixture provided by the angled slots and injection ports. Thus, the mixing tube comprises concentric-hollow cylinders 81 and 82 substantially as described above. One known liquid injection system useful with the invention includes a center body type liquid injector shown generally as 80 in FIG. 5 that typically includes a combination diffusion gas fuel injector and liquid injector. Injector 80 can thus comprise a centrally placed, diffusion-based liquid/gas fuel injector.

As FIG. 5 indicates, the discharge of the injector extends slightly beyond the last row of angled slots (shown generally as 83A through E) with the fuel/air mixture flowing from left to right into the combustion zone at 87. The supplemental liquid fuel injector 80 atomizes the fuel at 86 for combining with the mixture created using the concentric tube/tangential slot arrangement as previously described. Again, the use of a supplemental fuel injector is optional, depending on the exact fuel/air mixing conditions desired upstream of the combustor.

Figure 6:
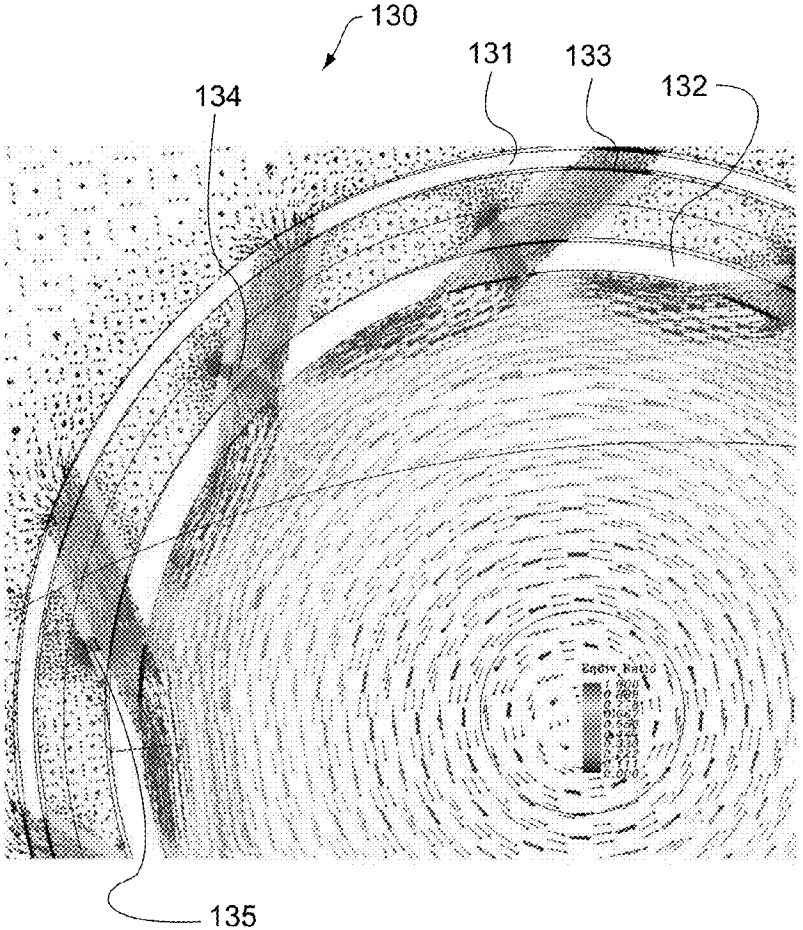
FIG. 6 is velocity vector chart depicting the relative changes in velocity and fuel/air flow patterns for the fuel/air mixture using a concentric hollow cylinders and aperture design according to the invention.

FIG. 6 is a velocity vector chart 130 showing the relative changes in velocity and fuel/air flow patterns for the fuel/air mixture using an exemplary air/fuel mixing tube design in accordance with the invention. Concentric hollow cylinders 131 and 132 include the same plurality of angled slots or openings 133, with selected ones of the openings having fuel injection ports shown at 134 and 135 that allow for the efficient injection of fuel into the air stream and the ultimate uniform mixing of fuel and air inside the mixing tube upstream of the combustor.

FIG. 6 also graphically illustrates the benefits achieved using a plurality of equidistant apertures positioned in circumferential rows around the mixing tube. The uniform mixing of air and the fuel from fuel injection ports results in the swirl driven flame stabilization described above inside the tube, and thus tends to lower the risk of flameholding/flashback (due to premature combustion). For purposes of clarity in FIG. 6, the different predicted axial velocities of the two components that form the mixture inside the tube are shown in color with the corresponding equivalence ratio legend depicted at the center of the figure.

It has been found that the flow of fuel in each row of angled slots through the individual injection ports (for example, as shown above in FIGS. 4A through 4C) will be essentially the same for all injection ports in a particular row, but may be slightly different for different rows of slots, depending on the fuel type and desired operating conditions upstream of the combustor. In addition, as FIG. 6 illustrates the air injection slots can be positioned such that the air flow entering the mixing tube will be in a generally counter-clockwise direction thereby creating a recirculation negative vector. Thus, compressed air flowing from outside the mixing tubes through the angled slots combines with fuel injected through selected injection ports, resulting in a uniform and stable fuel/air mixture prior to entering the combustion zone. A higher axial velocity exists as the mixture approaches the combustion zone, helping to avoid "flameholding/flashback" and avoid premature combustion (which might otherwise occur towards more upstream mixing zones).

Figure 7:
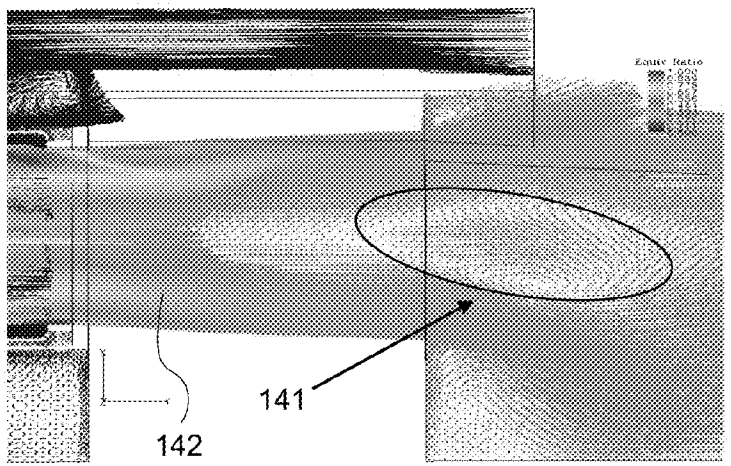
FIG. 7 is a graphical depiction of the relative fuel/air velocity and level of mixing that occurs due to improved recirculation of the fuel and air components using the invention, with a resulting zone of recirculation identified separately in the figure.

FIG. 7 is a graphical depiction of the fuel/air velocity profile 140 inside the mixing tube 142 illustrating the relative degree of mixing and flame stability due to recirculation achieved by the invention, with the slightly tilted zone of recirculation identified separately. The corresponding color code is shown in the upper right-hand portion of the figure. FIG. 7 thus shows an approximate "recirculation zone" or "recirculation bubble" 141 achieved due to the swirl driven flame stabilization described above, i.e., with the velocity vectors pointing in a direction opposite the bulk flow. The recirculation zone appears as the area tilted slightly inboard in the figure and occurs due to the improved mixing occurring in the tube that in turn ensures a smoother downstream combustion.

FIG. 7 also helps to illustrate another advantage of the invention using concentric hollow cylinders and a plurality of rows of angled slots and injection ports, namely the fuel/gas pressure recovery in the area immediately downstream of the mixing tube outlet as the fuel/air mixture approaches the combustion zone. FIG. 7 thus depicts the recovery of static pressure at different locations along the mixing tube, again demonstrating the benefits of the swirl driven flame stabilization achieved using the above mixing tube configuration. The improved mixing occurs at various axial planes inside the mixing tube as the fuel/air mixture moves toward the combustor, including the formation of a recirculation zone immediately downstream of the nozzle outlet. It has been found that the fuel/air mixing taking place is about 99% complete before the recirculation zone forms.

Figure 8:
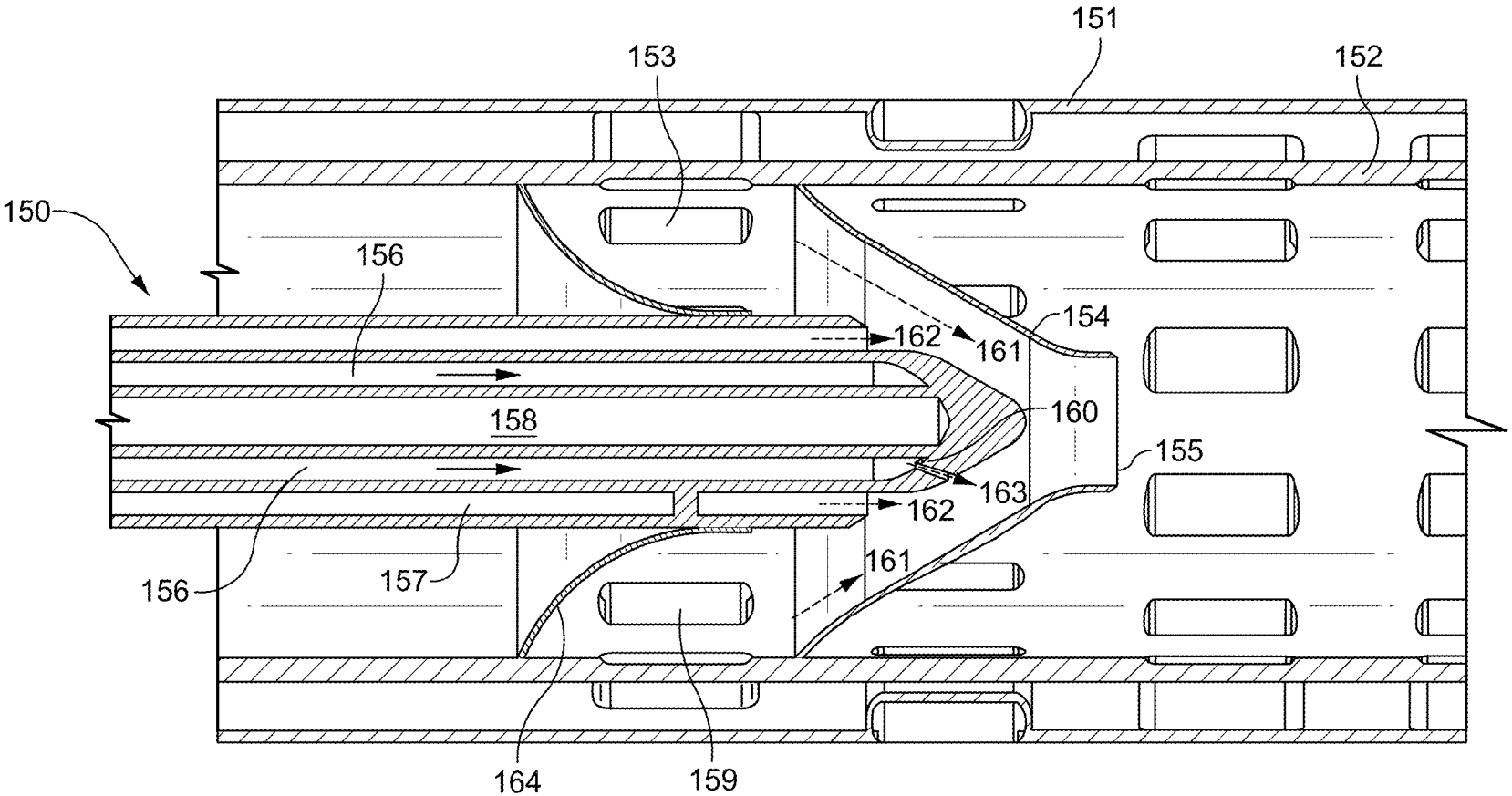
FIG. 8 is a cross-section view of an alternative embodiment of the present invention depicting the use of compressor discharge air in combination with a liquid fuel injection system located generally upstream of the slotted aperture configuration described in the first embodiment.

FIG. 8 is a cross-section view of an alternative embodiment of the present invention depicting the use of compressor discharge air in combination with a liquid fuel injection system positioned generally upstream of the mixing tube described in the embodiment of FIGS. 4A through 4C, namely a design using concentric hollow cylinders 151 and 152 and a plurality of angled slots 153 and 159 in the first row (which allow for the introduction of air alone without fuel). The difference in this embodiment is the use of a prescribed amount of supplemental liquid fuel that is atomized by separate atomizing air (such as air extracted from one of the compressor stages) or by using compressor discharge air, combustion inlet air, or both.

In this embodiment, the invention combines the new hollow cylinder/angled slot design with a centrally-disposed liquid injector positioned near an end plate upstream of the first row of angled slots (away from the mixing/combustion zone). In some instances, the use of supplemental liquid injection and compressed air to atomize the liquid fuel near the center of the nozzle tends to improve the overall combustion dynamics in terms of mixing efficiency and combustion thermodynamics. FIG. 8 thus depicts the use of a liquid injector to supplement the mixing achieved using concentric tubes and angled slots alone. Different designs of liquid injectors can be used in that combination, all of which tend to slightly alter the tangential velocity profile of the air/fuel mixture created by the mixing tube alone, depending on the type, design and exact position of the injector.

FIG. 8 also indicates that additional liquid fuel 156 moves into the liquid fuel injector 150 (flowing left to right) to be injected under pressure through a plurality of very small circumferential apertures in the nozzle head as shown by way of example at 163, with a portion of the liquid fuel impacting on the inside surface of atomizing bellows 154 to form a liquid fuel film at that point. Compressed atomizing air, typically at a temperature above ambient, enters the fuel injector through an atomizing air circuit 157 and flows at relatively high velocity into the mixing zone defined by atomizing bellows 154. In this illustration, additional atomizing air 161 can be injected using one or more of the angled slots 153 or 159 in the first row of slots of the mixing tube itself. This supplemental air flow serves to atomize the liquid fuel being injected through the circumferential openings 163. The air flow from the first row of angled slots is prevented from flowing backwards by backflow prevention wall 164.

The combined atomized fuel/air mixture in FIG. 8 leaves the injector through fuel/air opening 155 to be combined with other fuel/air mixtures being formed as described above using the basic mixing tube design. Again, the flow of air through angled slots 153 in the first row serves to atomize the liquid fuel as it flows down air passage 161. The air contacts the fuel on the interior surfaces of atomizing bellows 154. It has been found that the amount of air through the angled slots for all mixing tubes being used should not exceed about 15% of the total air flow through the nozzle.

The atomizing air in the atomizing air circuit 157 in this embodiment can be supplied from a stage of the gas turbine (or perhaps a compressor) and contemplates using additional gas fuel introduced through a central gas flow channel 158 directly into the mixing area using equally-spaced circumferential openings in the injector head that allow for the injection to take place immediately upstream of outlet 155 as shown.

Figure 9B:
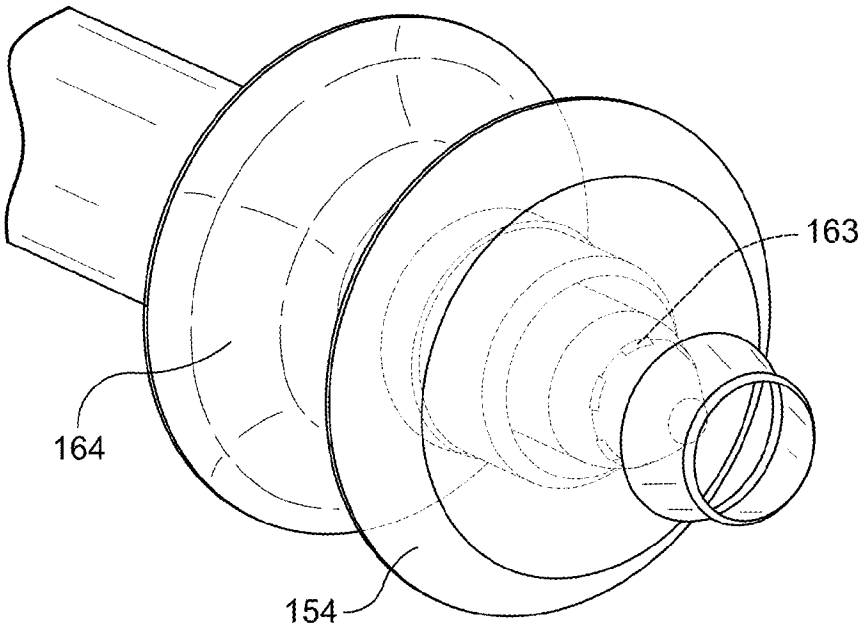
FIG. 9A is a front view of the liquid/compressed air fuel injection system of FIG. 8.
Figure 9A:
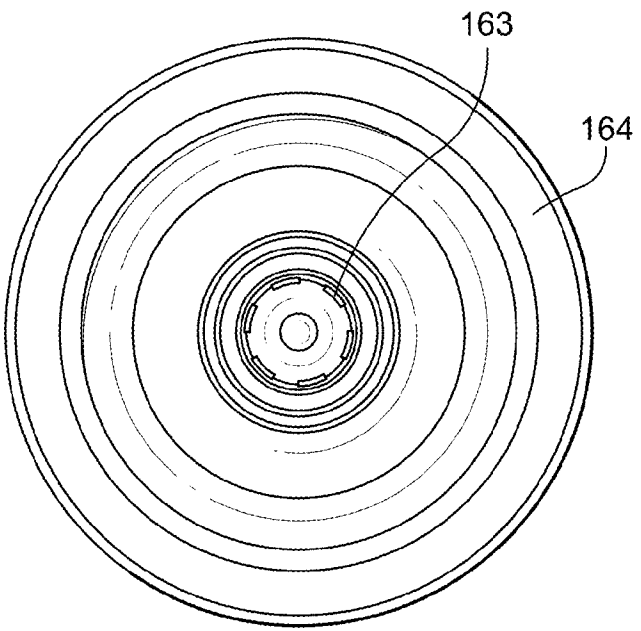

FIG. 9A is a front view of the liquid/compressed air fuel injection system depicted in the alternative embodiment of FIG. 8 showing the plurality of circumferential openings 163 that create a liquid film impacting on bellows 154 of the injection nozzle, thereby allowing for atomization of the liquid fuel using a compressed air flow as described. FIG. 9A also shows the use of backflow prevention wall 164.

FIG. 9B is a perspective view showing the liquid/compressor discharge air driven air fuel injection system depicted in the alternative embodiment of FIG. 8 with circumferential openings 163 disposed around the injection head.

Figure 10:
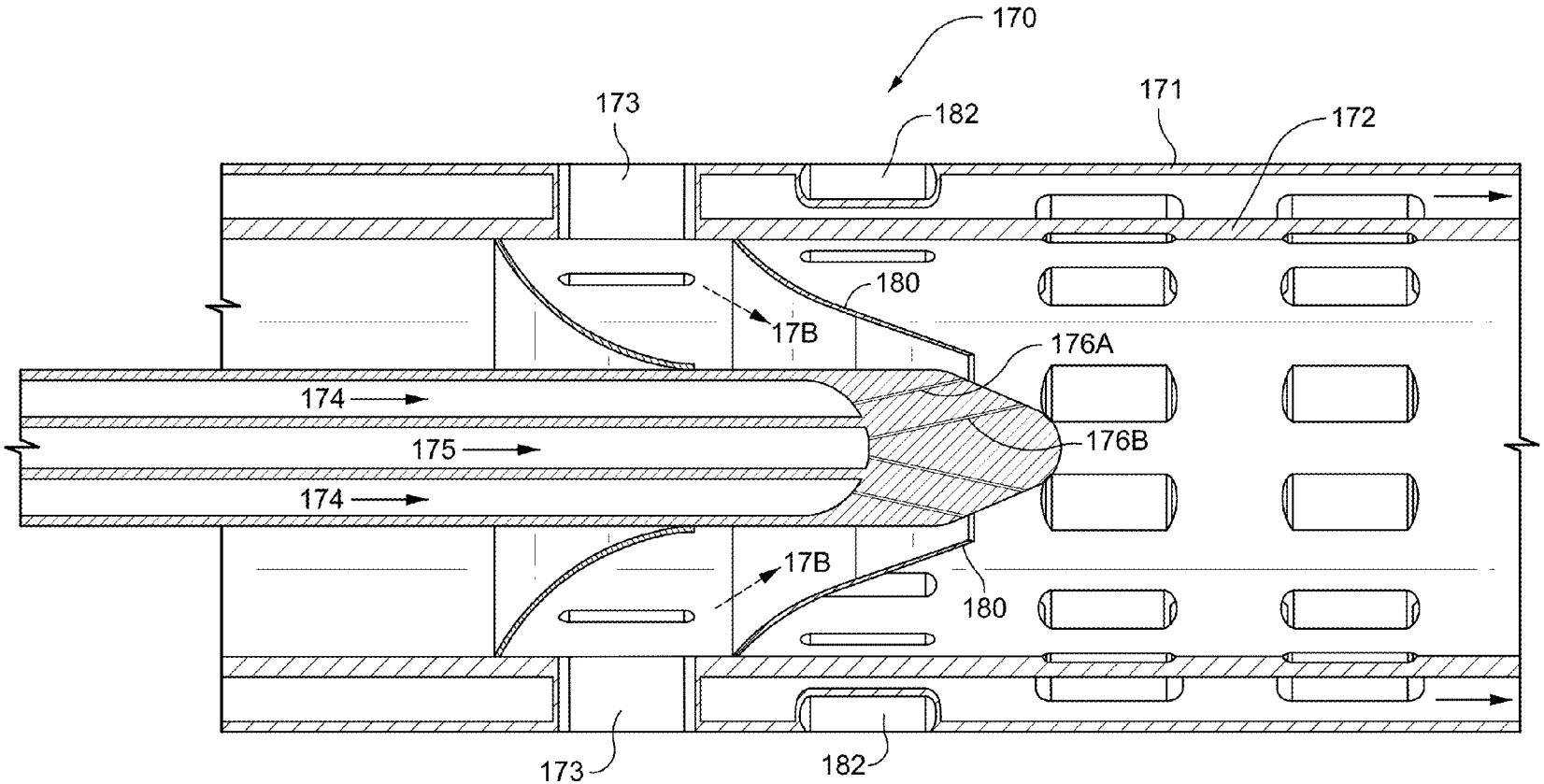
FIG. 10 is a cross-sectional view of a further embodiment of the present invention showing the use of an auxiliary compressed gas and liquid fuel mixing tube design having a plurality of axially-spaced fuel/air openings (angled slots)

FIG. 10 is cross-sectional view of a further embodiment 170 of the present invention illustrating the use of a gas and liquid fuel injector in combination with the plurality of fuel/air slots and concentric tubes in the mixing tube embodiment described in earlier figures. This embodiment includes concentric tubes 171 and 172 and a plurality of uniformly spaced rows of angled slots 173 and 182 as described. The first row of angled slots in the mixing tube provide a prescribed amount of supplemental air above ambient temperature down through passage 178 which serves to atomize a fixed amount of liquid fuel entering the nozzle through liquid fuel passage 174 in the center of the nozzle. The liquid fuel passes under pressure through a plurality of tiny, pinhole-type openings in the injection head (see injection ports 176A and 176B). Once again, a portion of the liquid fuel impacts against the interior wall of atomizing bellows 180, while the remainder passes out of the injector into the mixing zone created by the mixing tube itself.

Figure 11:
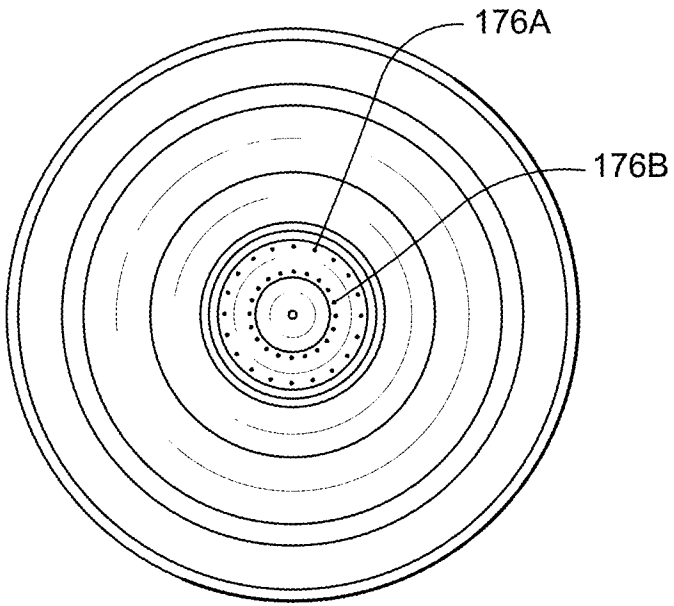
FIG. 11 is a front view of the compressed gas and liquid fuel injection nozzle shown in FIG. 10 for use in combination with the basic mixing tube design according to the invention.

FIG. 11 is a front view of the auxiliary compressed gas and liquid fuel nozzle shown in FIG. 10 depicting the use of one or more rows of pinhole injection ports 176A and 176E which discharge atomized liquid fuel into the mixture as described above in connection with FIGS. 8 and 10.

Figure 12:
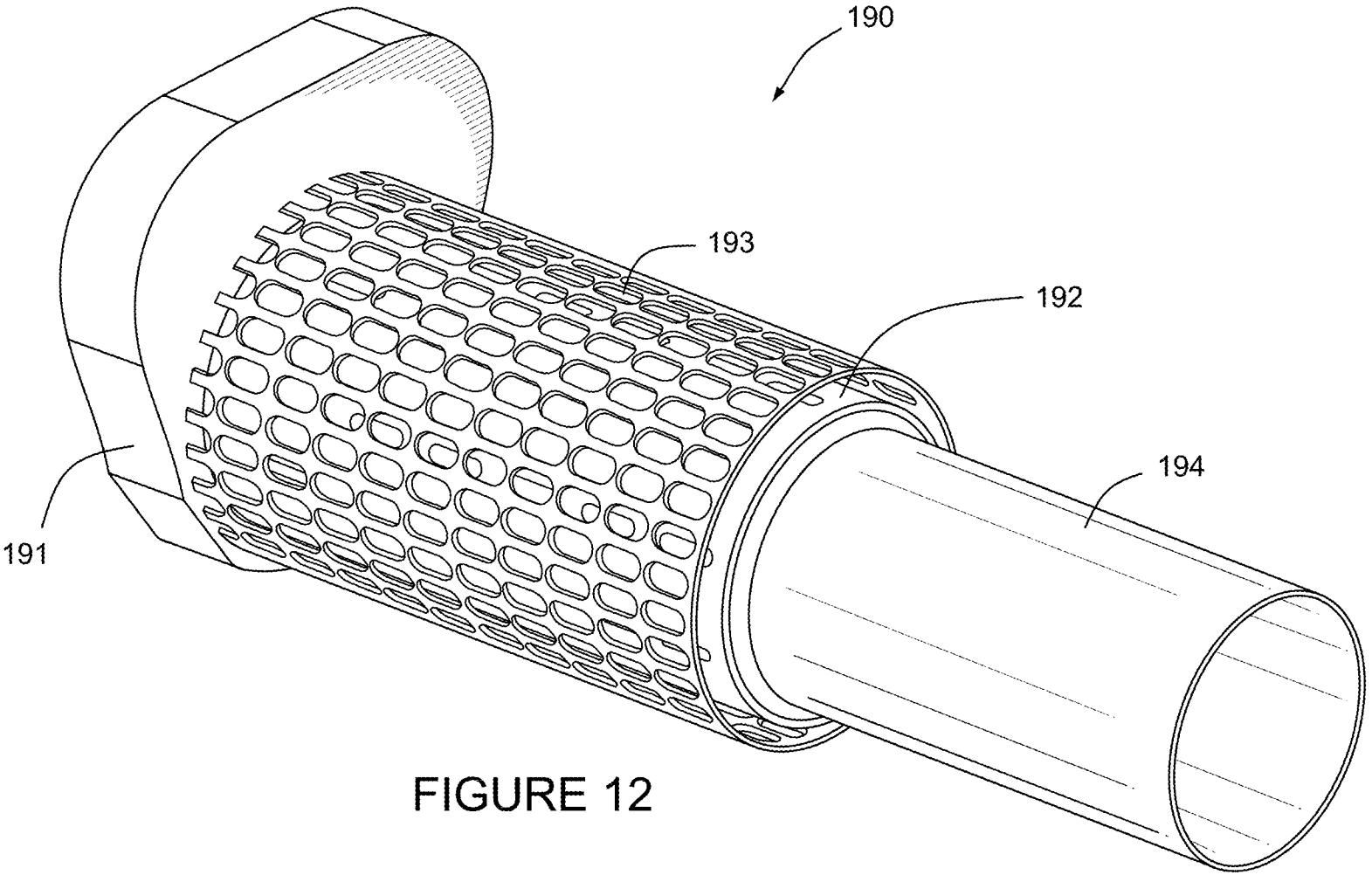
FIG. 12 is a perspective view of yet another embodiment of an exemplary mixing tube according to the invention that includes a uniformly perforated screen-like enclosure that serves to further enhance the mixing of fuel and air.

Finally, FIG. 12 is a perspective view of yet another embodiment 190 of the mixing tube design in accordance with the invention that includes a uniformly perforated screen-like enclosure surrounding the concentric tube/tangential air distribution slots. Mixing tube 192 is shown connected to flange 191 and surrounded by screen 193. It has been found that the use of perforated screen 193 assists in maintaining a uniform air flow into the angled slots, thereby further ensuring uniform mixing of the air and fuel inside the tube.

FIG. 12 also shows the use a conventional burner tube and cap assembly 194 that tends to further reduce any non-uniformities in the final mixture approaching the combustor after leaving the mixing tube. The size of the openings in the perforated screen and the dimensions of the circumferential air gap between the screen and outside surface of the mixing tube may vary slightly, depending on the exact operating conditions involved, including the amount of pressure drop that can be tolerated as air passes through the screen to reach the mixing tube.

In all of the above embodiments, the present invention contemplates using a variety of liquid hydrocarbon fuels in combination with a fuel/air gas mixture. For example, a dry oil injected through a mini nozzle could be used, with the liquid injected at a point generally upstream of the angled slots. The use of such dry oil combustion helps control the ultimate combustion temperature of the final fuel/air mixture and reduce the potential for forming NOX pollutants. It has also been found that various liquid fuels, including even dry oil, can be injected into the nozzle without additional water or steam to support combustion.

Thus, the invention achieves a "clean burn" without necessarily requiring steam or water injection with the fuel. Typically, the liquid fuel added to the system becomes atomized in the nozzle and then combines with the fuel/air mixture for use under certain load conditions on the gas turbine. Lower load conditions on the turbine normally use a fuel/air embodiment employing only angled slots, while higher load conditions can include the additional liquid fuel in combination with the slots as described.

While the invention has been described in connection with what is presently considered to be the most practical and preferred embodiments, it is to be understood that the invention is not to be limited to the disclosed embodiment, but on the contrary is intended to cover various modifications and equivalent arrangements included within the spirit and scope of the appended claims.

What is claimed is:

1. A mixing tube for combining gas fuel and air fed to the combustor of a gas turbine engine, comprising:

a pair of concentric hollow cylinders defining a ring-like annular path for the flow of gas fuel between said hollow cylinders;

a plurality of air injection slots formed in said concentric hollow cylinders that define a plurality of corresponding air flow paths from the outside substantially tangentially through said ring-like annular path into the interior of said mixing tube; said air injection slots arranged in axially-spaced, circumferential rows, and at least one fuel injection port extending through a wall at least partially defining a respective one of said plurality of air injection slots in one or more of said axially-spaced, circumferential rows to allow for the flow of fuel from said annular path into said air flow path.

2. A mixing tube according to claim 1, wherein said at least one fuel injection port comprises plural fuel injection ports in said air injection slots of some but not all of said axially-spaced circumferential rows.

3. A mixing tube according to claim 1, wherein said fuel injection ports comprise two or more small diameter openings through one side of said plurality of air injection slots to thereby define a fuel injection flow path.

4. A mixing tube according to claim 1, wherein said plurality of air injection slots include a first portion along the longitudinal axis having fuel injection ports and a second portion downstream of said first portion that do not include fuel injection ports.

5. A mixing tube according to claim 1, wherein said plurality of air injection slots are oriented to cause a clockwise or counter-clockwise flow of air into said mixing tube.

6. A mixing tube according to claim 1, further comprising a liquid fuel/compressed air injector disposed inside said mixing tube upstream of selected ones of said plurality of air injection slots to provide a supplemental atomized fuel and air feed to said combustor.

7. A mixing tube according to claim 6, wherein said liquid fuel/compressed air injector comprises a fuel injection nozzle having a plurality of pinhole openings discharging liquid fuel that becomes atomized by said compressed air before the mixture is discharged into said mixing tube.

8. A mixing tube according to claim 1, further comprising a perforated cylindrical screen disposed outside said plurality of hollow cylinders.

9. A fuel nozzle for providing an air and gas fuel mixture to the combustor of a gas turbine engine, comprising:

a plurality of fuel and air mixing tubes disposed at equidistant radial positions about the longitudinal axis of said fuel nozzle, wherein each mixing tube comprises a pair of concentric hollow cylinders defining a ring-like, annular flow path for fuel between said hollow cylinders, a plurality of air injection slots formed in said hollow cylinders to define a plurality of corresponding air flow paths from the outside substantially tangentially through the ring-like annular flow path into the interior of the mixing tube, and one or more fuel injection ports formed in selected ones of said plurality of air injection slots; and an end plate for securing each of said mixing tubes at one end thereof at corresponding equidistant radial positions about the longitudinal axis of said fuel nozzle.

10. A fuel nozzle according to claim 9, further comprising a cylindrical end cap sized to enclose the discharge ends of said plurality of mixing tubes at one end and open at the other end.

11. A fuel nozzle according to claim 9, wherein said plurality of air injection slots in each of said mixing tubes are disposed in rows along the longitudinal axis of each mixing tube.

12. A fuel nozzle according to claim 9, wherein said fuel injection ports in each mixing tube comprise two or more small diameter openings through one side of said air injection slots to thereby define corresponding fuel injection flow paths.

13. A fuel nozzle according to claim 9, wherein said air injection slots of each mixing tube include a first portion along the longitudinal axis having fuel injection ports and a second portion downstream of said first portion that do not include fuel injection ports.

14. A fuel nozzle according to claim 9, wherein each of said mixing tubes further comprises a perforated cylindrical screen disposed outside said hollow cylinders.

15. A distributed gas fuel and air combustion system for a gas turbine engine, comprising:

a combustor;

a fuel supply system for providing hydrocarbon fuel to said combustor;

a compressed air supply to said combustor; and a fuel nozzle for providing a distributed mixture of gas fuel and air to said combustor, said fuel nozzle comprising a plurality of fuel and air mixing tubes disposed about the longitudinal axis of said fuel nozzle, wherein each mixing tube comprises a pair of concentric hollow cylinders defining an annular flow path for fuel between the hollow cylinders, a plurality of air injection slots formed in said hollow cylinders extending substantially tangentially through said annular flow path and into an inner one of said pair of hollow-concentric cylinders, and one or more fuel injection ports formed in selected ones of said plurality of air injection slots.

* * * * *

UNITED STATES PATENT AND TRADEMARK OFFICE

CERTIFICATE OF CORRECTION

PATENT NO. : 8,590,311 B2
APPLICATION NO. : 12/768758
DATED : November 26, 2013
INVENTOR(S) : Parsania et al.

It is certified that error appears in the above-identified patent and that said Letters Patent is hereby corrected as shown below:

In the Specification:

At column 3, line 21, delete "FIG. 98" and insert --FIG. 9B--

At column 7, line 56, insert --and 52-- after "concentric tubes 51"

At column 11, line 65, delete "176E" and insert --176B--

Signed and Sealed this
Eleventh Day of February, 2014

Michelle K. Lee

Michelle K. Lee
*Deputy Director of the United States Patent and Trademark Office*